US009758322B2

(12) United States Patent
Tatematsu et al.

(10) Patent No.: US 9,758,322 B2
(45) Date of Patent: Sep. 12, 2017

(54) IMAGE FORMING APPARATUS AND SHEET SUPPORT TRAY

(71) Applicant: BROTHER KOGYO KABUSHIKI KAISHA, Nagoya-shi, Aichi-ken (JP)

(72) Inventors: Hirotaka Tatematsu, Nagoya (JP); Akira Terao, Ama (JP); Takashi Saito, Chiryu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/084,396

(22) Filed: Mar. 29, 2016

(65) Prior Publication Data

US 2016/0291520 A1 Oct. 6, 2016

(30) Foreign Application Priority Data

Mar. 31, 2015 (JP) ..... 2015-071122
Mar. 9, 2016 (JP) ..... 2016-045370

(51) Int. Cl.

| | |
|---|---|
| ***B65H 3/44*** | (2006.01) |
| ***B65H 1/04*** | (2006.01) |
| ***B65H 1/26*** | (2006.01) |
| ***G03G 21/16*** | (2006.01) |
| ***G03G 15/00*** | (2006.01) |

(52) U.S. Cl.

CPC ..... *B65H 1/04* (2013.01); *B65H 1/266* (2013.01); *B65H 3/44* (2013.01); *G03G 15/6514* (2013.01); *G03G 21/1695* (2013.01); *B65H 2402/46* (2013.01); *B65H 2405/324* (2013.01); *B65H 2405/332* (2013.01); *B65H 2407/21* (2013.01); *G03G 2221/1654* (2013.01); *G03G 2221/1684* (2013.01)

(58) Field of Classification Search

CPC ... B32H 3/44; B65H 3/44; B65H 1/04; B65H 1/266; B65H 2405/324; B65H 2405/332; B65H 2407/21; G03G 15/6514; G03G 2215/00392

See application file for complete search history.

(56) References Cited

U.S. PATENT DOCUMENTS 4,579,328 A * 4/1986 Hagihara ..... B65H 1/04 271/119
4,791,457 A * 12/1988 Shida ..... B65H 5/26 271/119
2014/0016980 A1 1/2014 Minoshima

FOREIGN PATENT DOCUMENTS

JP 2004-196516 A 7/2004
JP 2014-015315 A 1/2014
JP 2015-020884 A 2/2015

* cited by examiner

*Primary Examiner* — Luis A Gonzalez
(74) *Attorney, Agent, or Firm* — Merchant & Gould P.C.

(57) ABSTRACT

An image forming apparatus includes a removable sheet support tray. The sheet support tray includes a sheet support surface providing a sheet support area above the sheet support surface. The support tray also includes a stopper portion movable between a restraining position and a non-restraining position that is a different position from the restraining position. In a state where the stopper portion is located at the restraining position, the stopper portion includes a surface disposed adjacent to and downstream of the sheet support area in a first direction, the first direction extending along at least a portion of the sheet support surface.

20 Claims, 8 Drawing Sheets

IMAGE FORMING APPARATUS AND SHEET SUPPORT TRAY

CROSS-REFERENCE TO RELATED APPLICATIONS

This application claims priority from Japanese Patent Application No. 2016-045370, filed on Mar. 9, 2016, which claims priority from Japanese Patent Application No. 2015-071122, filed on Mar. 31, 2015, each of which is incorporated herein by reference in its entirety.

TECHNICAL FIELD

Aspects described herein relate to an image forming apparatus configured to form an image onto a sheet and a sheet support tray for supporting a sheet thereon.

BACKGROUND

For example, a known image forming apparatus includes a housing and a feed roller disposed inside the housing. In the image forming apparatus, a manual feed tray is connected with a frame disposed inside the housing by insertion into the housing toward the feed roller. The housing accommodates therein, for example, an image forming mechanism for forming an image onto a sheet, and a feed mechanism including the feed roller for feeding a sheet toward the image forming mechanism. A sheet (which refers to one or more sheets) supported by the manual feed tray connected with the frame is fed toward the image forming mechanism by the feed roller.

SUMMARY

In accordance with the present disclosure, in a first aspect, an image forming apparatus includes an image forming mechanism, a frame supporting the image forming mechanism, and a housing covering the frame. The image forming apparatus further includes a removable tray configured to be attachable to and detachable from the frame. The removable tray includes a sheet support surface providing a sheet support area, as well as a stopper portion movable between a restraining position and a non-restraining position that is at a different position from the restraining position. In a state where the stopper portion is locate at the restraining position, the stopper portion includes a surface disposed adjacent to and downstream of the sheet support area in a first direction that extends along at least a portion of the sheet support surface.

In a second aspect, a sheet support tray is disclosed that is removable from an image forming apparatus. The sheet support tray includes a sheet support surface providing a sheet support area, as well as a stopper portion movable between a restraining position and a non-restraining position that is at a different position from the restraining position. In a state where the stopper portion is locate at the restraining position, the stopper portion includes a surface disposed adjacent to and downstream of the sheet support area in a first direction that extends along at least a portion of the sheet support surface.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

In the following description, the expression "above", "under", "right", "left", "upper" and "lower" are used throughout the description to define the various parts when an image forming apparatus 1 is disposed in an orientation in which it is intended to be used.

(Illustrative Embodiment)

1. Overview of Image Forming Apparatus

Figure 1:
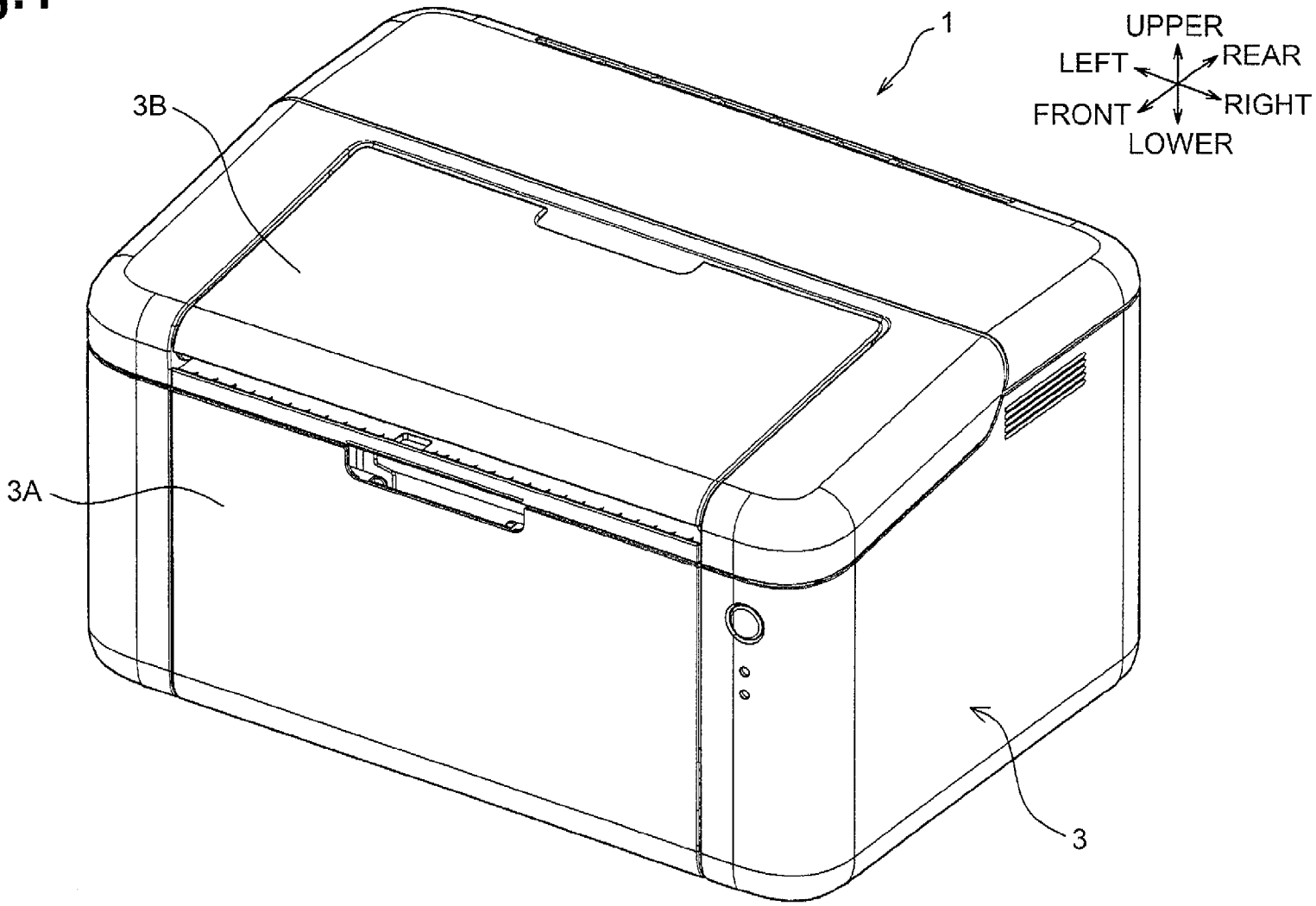
FIG. 1 is an external view depicting an image forming apparatus in an illustrative embodiment according to one or more aspects of the disclosure.

As depicted in FIG. 1, the image forming apparatus 1 includes a housing 3 having a substantially rectangular parallelepiped shape and six faces. The housing 3 constitutes an exterior of the image forming apparatus 1. The housing 3 includes a feed cover 3A and a discharge cover 3B. As depicted in FIG. 4, the housing 3 covers a frame 15 of the image forming apparatus 1. As depicted in FIG. 1, the feed cover 3A constitutes, for example, a portion of the front of the housing 3. The feed cover 3A is connected with the frame 15 so as to be pivotable frontward on a pivot shaft (not depicted) disposed at a lower end portion of the feed cover 3. The discharge cover 3B constitutes, for example, a portion of the top of the housing 3. The discharge cover 3B is connected with the frame 15 so as to be pivotable frontward on a pivot shaft (not depicted) disposed at a front end portion of the discharge cover 3B. The discharge cover 3B supports a sheet (which refers to one or more sheets throughout the explanation) thereon in a state where the discharge cover 3B is opened toward the front of the image forming apparatus 1 by rotation. The discharge cover 3B supports a sheet that has an image formed thereon by an image forming mechanism 5 and has been outputted to the outside of the housing 3.

<Frame>

Figure 2:
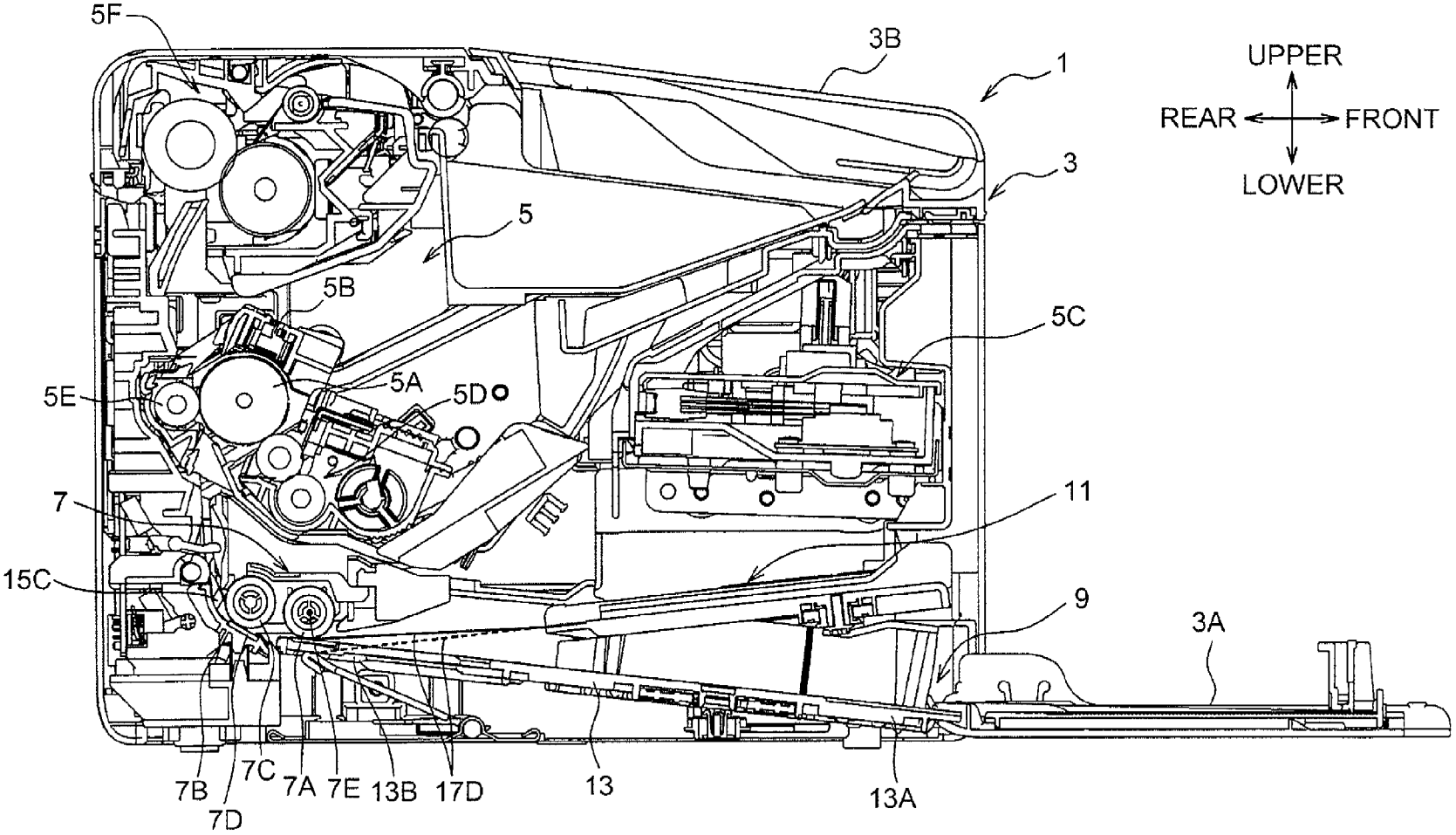
FIG. 2 is a cross-sectional side view depicting the image forming apparatus in the illustrative embodiment according to one or more aspects of the disclosure, wherein a removable tray is connected with a frame of the image forming apparatus.
Figure 3:
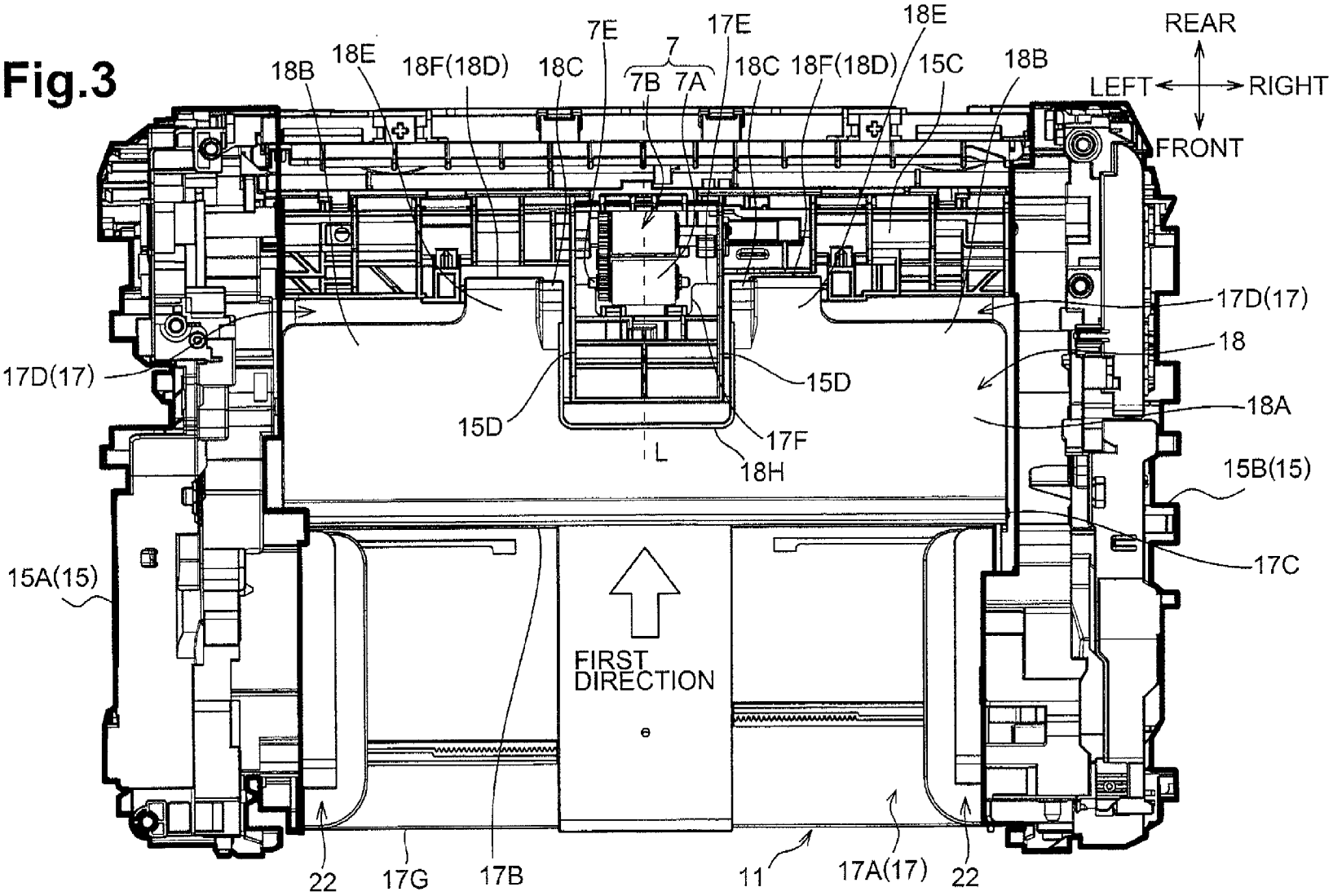
FIG. 3 is a sectional plan view depicting the image forming apparatus in the illustrative embodiment according to one or more aspects of the disclosure, wherein the removable tray is connected with the frame.

As depicted in FIGS. 2 and 4, the frame 15 includes a first frame 15A, a second frame 15B, a feed frame 15C, and a plurality of, for example, two, sidewalls 15D. The first frame 15A may be a wall-like reinforcing member that constitutes a left portion of the image forming apparatus 1 and is covered by a left surface of the housing 3. The second frame 15B may be a wall-like reinforcing member that constitutes a right portion of the image forming apparatus 1 and is covered by a right surface of the housing 3. The feed frame 15C (as an example of a second guide) constitutes a rear portion of the image forming apparatus 1 and is covered by a rear surface of the housing 3. The feed frame 15C guides conveyance of a sheet fed by a feed roller 7A toward the image forming mechanism 5. The feed frame 15C includes the sidewalls 15D. The sidewalls 15D are disposed at a substantially middle portion of the image forming apparatus 1 in a right-left direction while extending frontward. As depicted in FIG. 3, the sidewalls 15D are disposed symmetrically with respect to an imaginary line L that divides the image forming apparatus 1 into two equal portions in the right-left direction. The sidewalls 15D are disposed on opposite sides of a feed unit 7 in the right-left direction. The first frame 15A and the feed frame 15C are fastened to each other using screws. Similar to this, the second frame 15B and the feed frame 15C are also fastened to each other using screws.

The frame 15 supports the image forming mechanism 5, the feed unit 7, a feed tray 9, a removable tray 11, a plurality of, for example, two, rails 20, and a plurality of, for example, two, retaining portions 21.

The right-left direction of the image forming apparatus 1 may be orthogonal to a sheet feeding direction that the feed roller 7A feeds a sheet.

<Image Forming Mechanism>

The image forming mechanism 5 forms an image onto a sheet using an electrophotographic printing method. As depicted in FIG. 2, the image forming mechanism 5 includes a photosensitive drum 5A, a charging device 5B, an exposure device 5C, a developing device 5D, a transfer roller 5E, and a fixing device 5F. The photosensitive drum 5A carries a developing agent image on its surface. The charging device 5B charges the surface of the photosensitive drum 5A.

The exposure device 5C exposes the charged surface of the photosensitive drum 5A to form an electrostatic latent image on the surface of the photosensitive drum 5A. The developing device 5D develops the electrostatic latent image formed on the surface of the photosensitive drum 5A using a developing agent to form a developing agent image. The transfer roller 5E transfers the developing agent image carried by the surface of the photosensitive drum 5A onto a sheet. The fixing device 5F fixes the transferred developing agent image onto the sheet.

In the illustrative embodiment, the image forming apparatus 1 forms an image onto a sheet using an electrophotographic printing method. Nevertheless, in other embodiments, for example, the image forming apparatus 1 may form an image onto a sheet using another printing method, for example, using an inkjet printing method.

<Feed Unit>

As depicted in FIGS. 2 and 3, the feed unit 7 is disposed in a lower rear portion of the housing 3 of the image forming apparatus 1. The feed unit 7 is disposed on the imaginary line L. The feed unit 7 feeds a sheet supported by one of the feed tray 9 and the removable tray 11 rearward. The feed unit 7 includes the feed roller 7A and a separator portion 7B.

The feed roller 7A rotates on a rotating shaft 7E thereof while contacting an upper surface of a sheet supported by one of the feed tray 9 and the removable tray 11, thereby feeding the sheet. The feed roller 7A is disposed on the imaginary line L while being positioned between the sidewalls 15D in an axial direction of the rotating shaft 7E.

In case that the feed roller 7A feeds multiple sheets at a time, the separator portion 7B separates the multiple sheets into a single sheet and then conveys the separated sheet. The separator portion 7B includes a separating roller 7C and a separating pad 7D.

The separating roller 7C rotates while contacting an upper surface of a sheet fed by the feed roller 7A. The separating pad 7D is disposed at the feed frame 15C facing the separating roller 7C. The separating pad 7D applies a frictional force to a sheet fed by the feed roller 7A by contacting a lower surface of the fed sheet.

<Feed Tray>

Figure 4A:
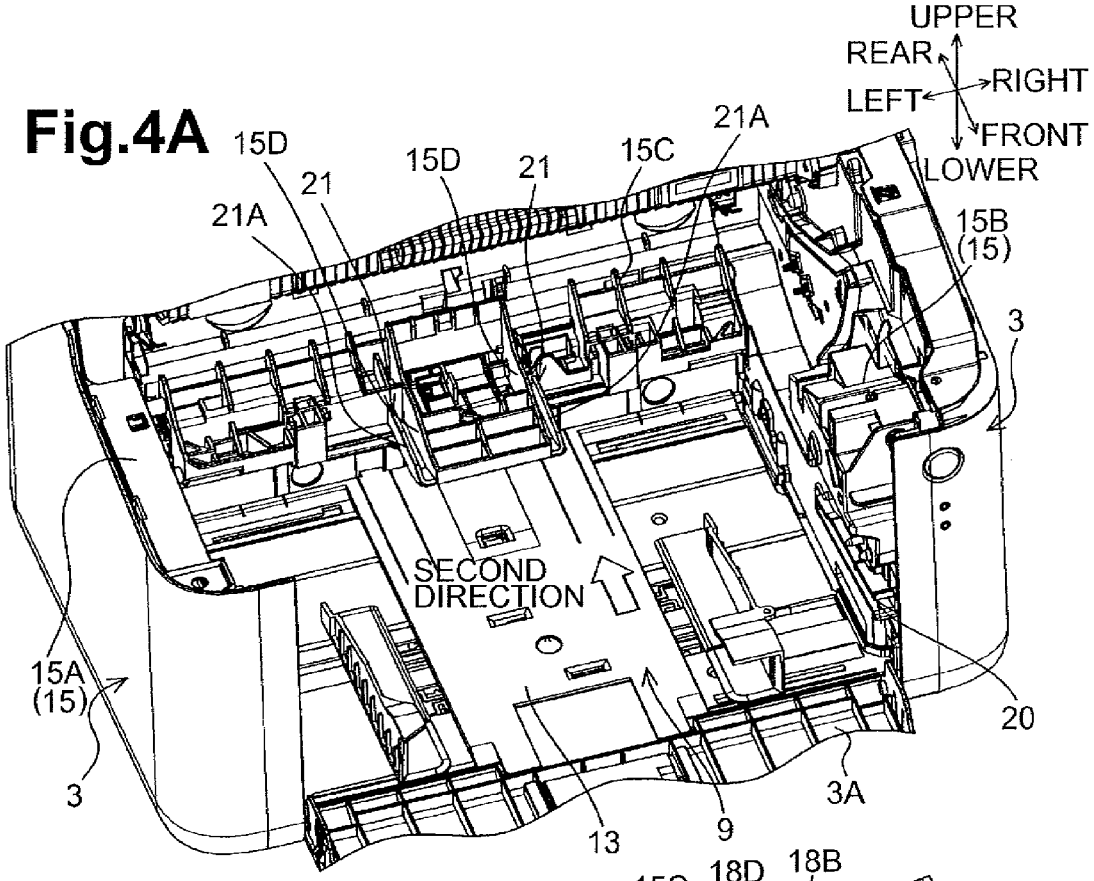
FIG. 4A is a perspective view depicting an internal configuration of a housing of the image forming apparatus in the illustrative embodiment according to one or more aspects of the disclosure, wherein the removable tray is not located inside the housing.

As depicted in FIGS. 2 and 4A, the feed tray 9 constitutes a lower portion of the image forming apparatus 1. The feed tray 9 is disposed below the removable tray 11 supported at an attached position by the frame 15. The feed tray 9 includes a pressing plate 13. The pressing plate 13 is pivotable selectively in a direction that the pressing plate 13 approaches the feed roller 7A (hereinafter, also referred to as an approaching direction) and in a direction that the pressing plate 13 recedes from the feed roller 7A (hereinafter, also referred to as a receding direction). More specifically, the pressing plate 13 includes a front end portion 13A and a rear end portion 13B. The front end portion 13A of the pressing plate 13 is supported by a pivot shaft extending in the right-left direction such that the pressing plate 13 is pivotable relative to the image forming apparatus 1. The pressing plate 13 pivots on the pivot shaft from a position where the pressing plate 13 extends along a bottom surface of the housing 3 to a position where the rear end portion 13B of the pressing plate 13 is in contact with the feed roller 7A. Therefore, as the pressing plate 13 moves in the approaching direction while the pressing plate 13 supports a sheet thereon, the pressing plate 13 presses the sheet against the feed roller 7A and the feed roller 7A feeds the sheet pressed thereto, toward the rear.

As depicted in FIG. 2, the feed cover 3A constitutes a portion of the feed tray 9 in a state where the feed cover 3A is opened toward the front by rotation and extends along an installation surface of the image forming apparatus 1. For example, in a case where an A4-size sheet is placed on the feed tray 9 such that longer sides of the sheet extend along the sheet feeding direction of the feed roller 7A, the A4-size sheet is supported by both the pressing plate 13 and the feed cover 3A.

<Removable Tray>

Figure 4B:
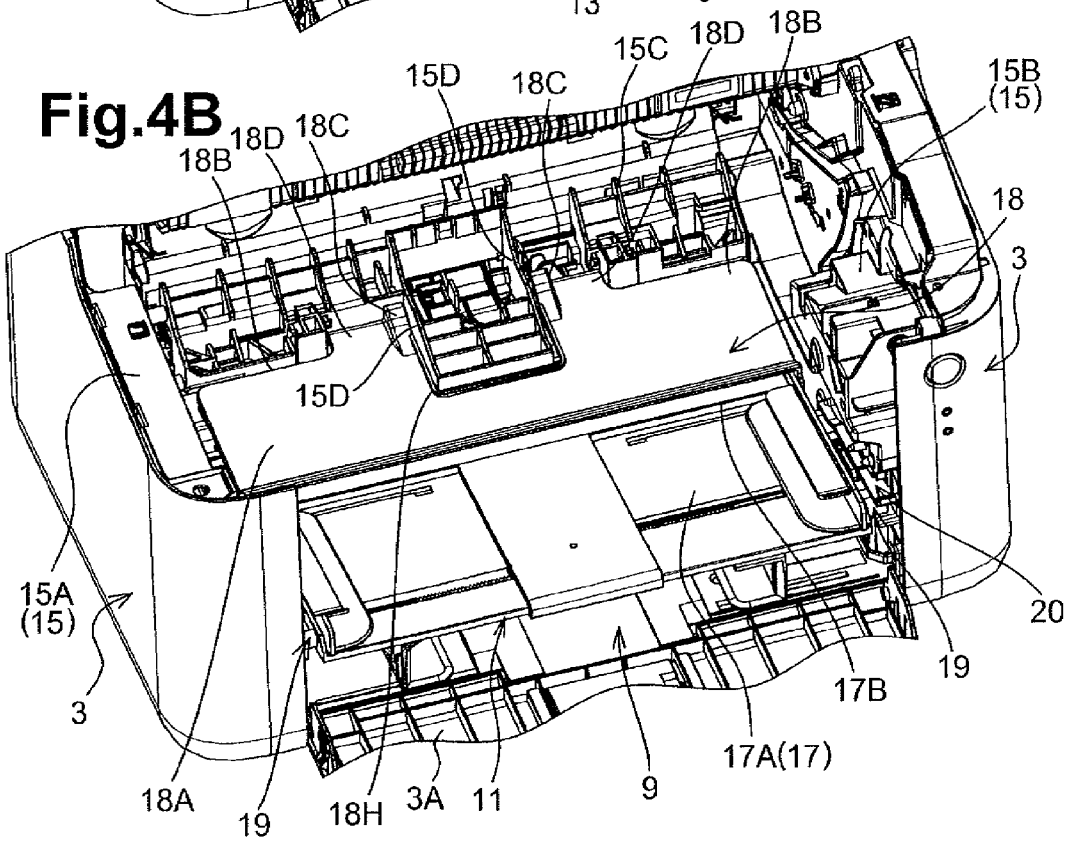
FIG. 4B is a perspective view depicting the internal configuration of the housing in the illustrative embodiment according to one or more aspects of the disclosure, wherein the removable tray is connected with the frame.

As depicted in FIGS. 2 and 4B, the removable tray 11 is detachably connected with and supported by the frame 15 while being positioned above the discharge tray 9 and below the image forming mechanism 5 in an up-down direction of the image forming apparatus 1. The removable tray 11 is attachable or connectable to and detachable from the frame 15, which may refer to that the frame 15 and the removable tray 11 might not be damaged or disassembled at the time of connecting the detached removable tray 11 to the frame 15 and at the time of detaching the removable tray 11 from the frame 15.

As depicted in FIG. 2, in a state where the feed cover 3A extends along the installation surface of the image forming apparatus 1, a user is permitted to insert or pull out the removable tray 11 into or from the housing 3 from the front of the image forming apparatus 1.

In a state where the removable tray 11 is supported by the frame 15, an entire portion of the removable tray 11 is accommodated in the housing 3. Therefore, the feed cover 3A may be closed while the removable tray 11 is left connected with the frame 15. In other embodiments, for example, a portion of the removable tray 11 may protrude to the outside of the housing 3 in the state where the removable tray 11 is supported by the frame 15.

In the state where the removable tray 11 is supported by the frame 15, the removable tray 11 is inclined downward toward the rear of the image forming apparatus 1. In the state where the removable tray 11 is supported by the frame 15, when the pressing plate 13 is not in contact with a second support member 17D of the removable tray 11, the second support member 17D is located at a position indicated by a dashed line in FIG. 2. As the pressing plate 13 moves in the approaching direction, the rear end portion 13B of the pressing plate 13 comes into contact with the second support member 17D of the removable tray 11 located at the position indicated by the dashed line in FIG. 2 to press the second support member 17D in a direction that the second support member 17D approaches the feed roller 7A. Upon contact of the pressing plate 13 with the feed roller 7A, the second support member 17D pressed by the pressing plate 13 stops moving in the direction the second support member 17D approaches the feed roller 7A. At that time, when the removable tray 11 supports no sheet, the second support member 17D is located at a position indicated by a solid line indicated in FIG. 2 and in contact with the feed roller 7A directly. When the removable tray 11 supports a sheet, the pressing plate 13 presses the sheet supported by the second support member 17D of the removable tray 11 against the feed roller 7A. Thus, the feed roller 7A feeds the sheet pressed thereto toward the rear.

Hereinafter, the direction that a sheet moves relative to the removable tray 11 at the time of feeding the sheet rearward by the feed roller 7A may also be referred to as a first direction. The position of the removable tray 11 relative to the frame 15 when a sheet supported by the second support member 17D comes into contact with the second support member 17D due to pressing of the second support member 17D by the pressing plate 13 may also be referred to as an attached position. The position of a sheet relative to the removable tray 11 when the sheet supported by the second support member 17D comes into contact with the feed roller 7A in a state where the removable tray 11 is supported at the attached position by the frame 15 may also be referred to as a normal position.

<Rails>

One of the rails 20 is disposed at the first frame 15A of the frame 15 and the other of the rails 20 is disposed at the second frame 15B of the frame 15. Although FIG. 4 illustrates the rail 20 of the second frame 15B only, the rail 20 of the first frame 15A also has the same or similar configuration to the rail 20 of the second frame 15. As depicted in FIG. 4B, the rail 20 extends rearward for guiding insertion of the removable tray 11 into the housing 3 to the attached position and supporting the removable tray 11. Hereinafter, the direction that the rail 20 guides the insertion of the removable tray 11 into the housing 3 may also be referred to as a second direction. In the illustrative embodiment, the second direction may be the same direction as the first direction.

<Retaining Portions>

Figure 8A:
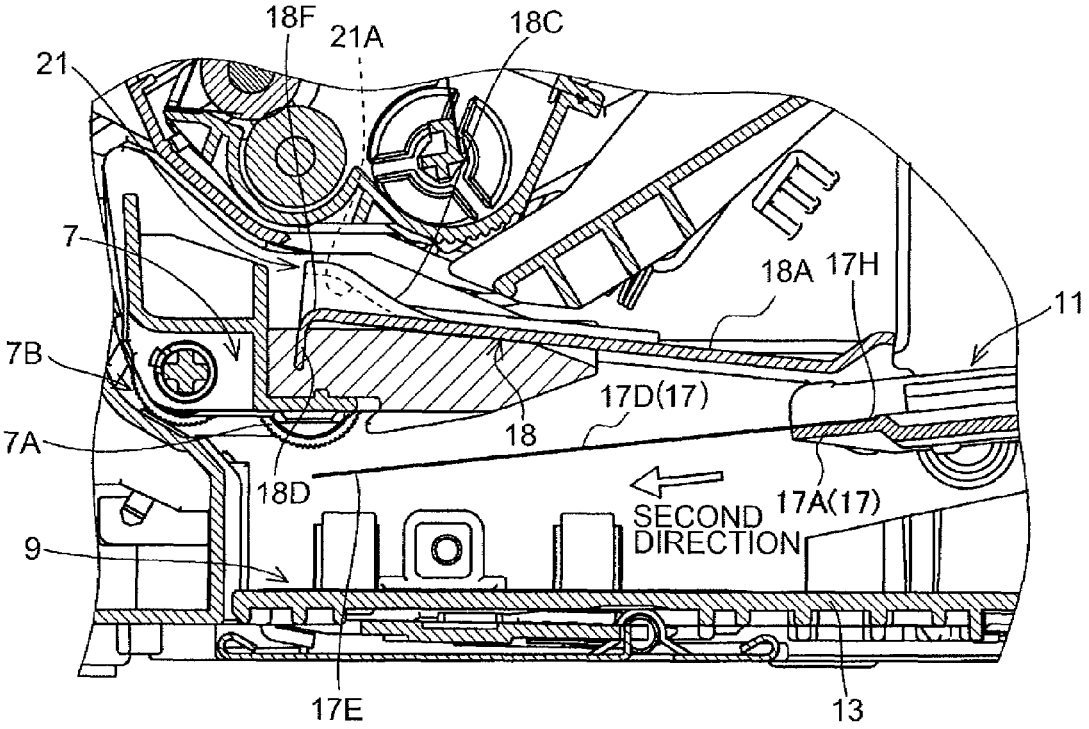
FIG. 8A is an enlarged cross-sectional side view depicting surroundings of a feed unit and the removal tray in the image forming apparatus in the illustrative embodiment according to one or more aspects of the disclosure.

As depicted in FIG. 4A, the retaining portions 21 are disposed at the respective sidewalls 15D. As depicted in FIGS. 4B and 8A, in a state where the removable tray 11 is supported at the attached position by the frame 15, the retaining portions 21 are in contact with respective guide portions 18C of a stopper portion 18 of the removable tray 11 to retain the stopper portion 18 of the removable tray 11 at a non-restraining position (refer to FIGS. 6 and 8A).

2. Detailed Configuration of Removable Tray, Rails, and Retaining Portions

<Detailed Configuration of Removable Tray>

Figure 5:
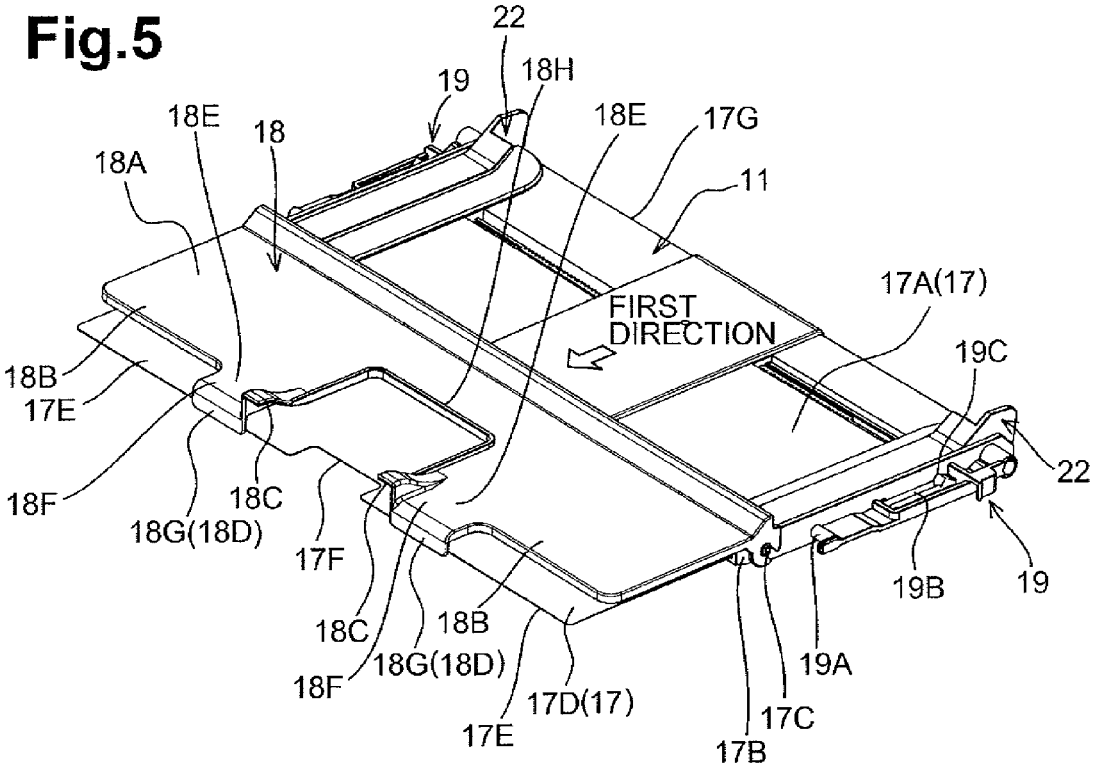
FIG. 5 is a perspective view depicting the removable tray in the illustrative embodiment according to one or more aspects of the disclosure, wherein a stopper portion is located at a restraining position.
Figure 6:
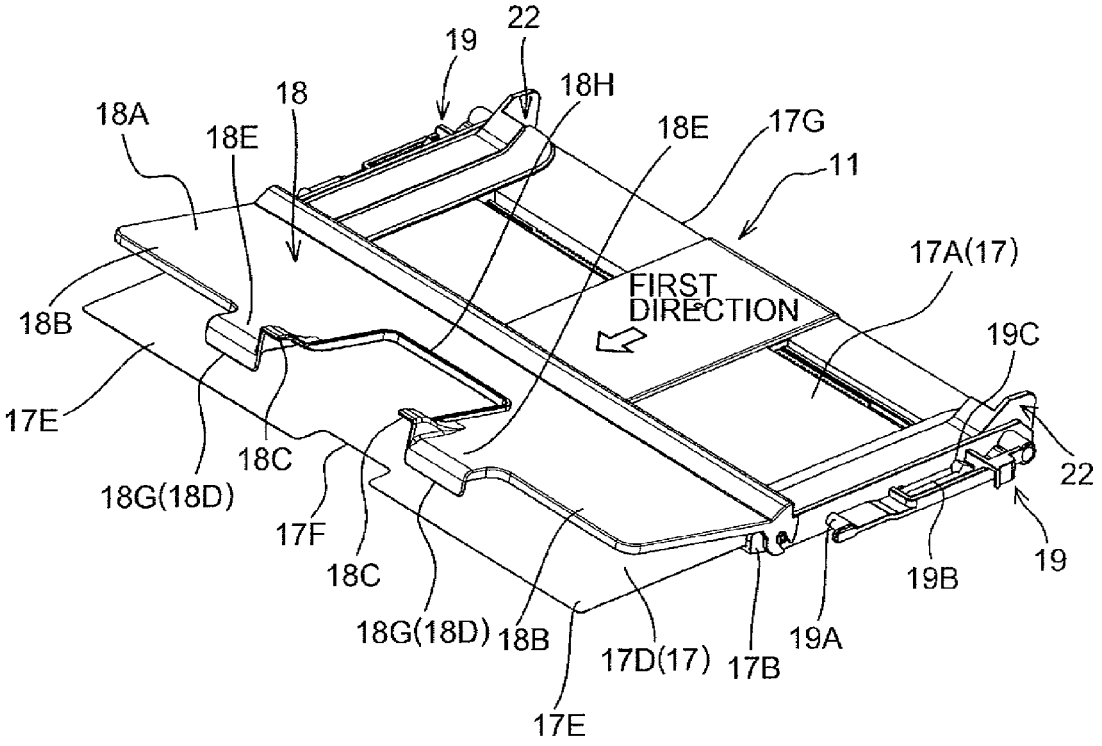
FIG. 6 is a perspective view depicting the removable tray in the illustrative embodiment according to one or more aspects of the disclosure, wherein the stopper portion is located at a non-restraining position.

As depicted in FIGS. 5 and 6, the removable tray 11 includes a support member 17, a stopper portion 18, a plurality of, for example, two, retained portions 19, and a plurality of, for example, two, side guides 22.

<Support Member>

The support member 17 may be a plate-like member for supporting a sheet thereon. The support member 17 includes a first support member 17A, a second support member 17D, and a pivot shaft 17C. An arrow indicated in each of FIGS. 5 and 6 may represent the first direction, e.g., the direction that a sheet moves relative to the support member 17 at the time of feeding the sheet by the feed roller 7A.

The first support member 17A has a rigid body and supports an upstream portion of a sheet in the first direction. In the illustrative embodiment, the first support member 17A may be an injection molded member made of resin, for example, acrylonitrile butadiene styrene (ABS resin). The first support member 17A has an upper surface including a sheet support area capable of supporting a sheet. With respect to the first direction, the sheet support area may be defined between an upstream end 17G and a downstream end 17B of the first support member 17A in the first direction. The first support member 17A has a dimension that is greater than longer sides of an A5-sized sheet in a direction that extends orthogonal to the first direction and along a surface of the sheet. The second support member 17D is connected with a downstream end 17B of the first support member 17A in the first direction. Hereinafter, the direction that extends orthogonal to the first direction and along a surface of a sheet may also be referred to as a width direction. The width direction may correspond to the right-left direction of the image forming apparatus 1.

The side guides 22 are movable in the width direction relative to the first support member 17A. At respective positions where the side guides 22 are in contact with respective edges of a sheet supported by the upper surface of the first support member 17A in the width direction, the side guides 22 are capable of restricting movement of the sheet in the width direction. Therefore, with respect to the width direction, the sheet support area of the upper surface of the first support member 17A may be defined between a position corresponding to one of the side guides 22 and another position corresponding to the other of the side guides 22. The second support member 17D has a plate-like shape and extends in the first direction from the downstream end 17B of the first support member 17A. The second support member 17D supports a downstream portion of a sheet in the first direction. The second support member 17D has a dimension that is substantially the same dimension as the first support member 17A in the width direction and is longer than the longer sides of an A5-sized sheet. The second support member 17D has a dimension in the first direction that is shorter than shorter sides of an A5-sized sheet.

The second support member 17D has an upper surface including a sheet support area, which is defined between an upstream end 17H (refer to FIG. 8A) and a downstream end 17E of the second support member 17D with respect to the first direction. With respect to the width direction, the sheet support area is defined between a position corresponding to one of the side guides 22 and another position corresponding to the other side guides 22.

Figure 8B:
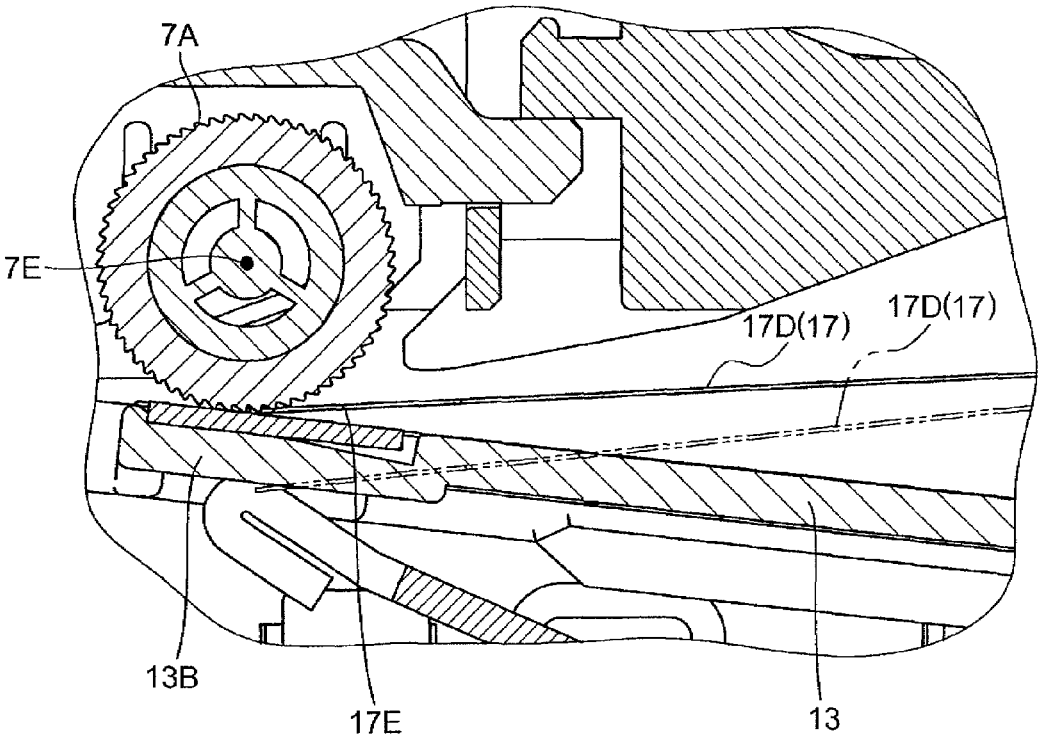
FIG. 8B is an enlarged cross-sectional side view depicting a second support member pressed by a pressing plate in the image forming apparatus in the illustrative embodiment according to one or more aspects of the disclosure.

The second support member 17D has a lower flexural rigidity in the width direction than the first support member 17A. More specifically, the second support member 17D is deformed by pressure of the pressing plate 13 that presses the second support member 17D in the direction that the second support member 17D approaches the feed roller 7A in the state where the removable tray 11 is supported at the attached position by the frame 15. The first support member 17A is not deformed by pressure of the pressing plate 13 that presses the second support member 17D in the direction that the second support member 17D approaches the feed roller 7A in the state where the removable tray 11 is supported at the attached position by the frame 15. The second support member 17D is movable selectively in the direction that the second support member 17D approaches the feed roller 7A by pressure of the pressing plate 13 (e.g., in a direction that the second support member 17D moves toward the position indicated by the solid line in FIG. 8B from the position indicated by the double-dotted-and-dashed line in FIG. 8B) and in a direction that the second support member 17D recedes from the feed roller 7A by disengagement of the pressing plate 13 (e.g., in a direction that the second support member 17D moves toward the position indicated by the double-dotted-and-dashed line in FIG. 8B from the position indicated by the solid line in FIG. 8B), in a state where the removable tray 11 is supported at the attached position by the frame 15.

In a state where the pressing plate 13 supports a sheet thereon, the second support member 17D is pressed by the pressing plate 13 indirectly via the sheet supported by the pressing plate 13.

In the illustrative embodiment, the second support member 17D may be made of elastic resin, for example, polyethylene terephthalate ("PET"). Thus, the movement of the second support member 17D in the respective two directions may be implemented with a simple configuration. In other words, it may be unnecessary for the second support member 17D to have a special mechanical configuration.

As depicted in FIG. 3, in the state there the removable tray 11 is supported at the attached position by the frame 15, a distal end of a downstream end portion 17E of the second support member 17D in the first direction coincides with an axis of the rotating shaft 7E of the feed roller 7A in the first direction. As depicted in FIGS. 3, 5, and 6, the second support member 17D has a recess 17F at a substantially middle portion of the downstream end portion 17E in the width direction. The recess 17F has a dimension in the width direction that is greater than a dimension in the axial direction of the feed roller 7A. With this configuration, even when the pressing plate 13 presses the removable tray 11 toward the feed roller 7A, the downstream end portion 17E of the second support member 17D does not come into contact with the feed roller 7A. Therefore, the recess 17F enables a sheet supported by the pressing plate 13 to come into contact with the feed roller 7A. In other words, the second support member 17D has a shape that allows a sheet supported by the pressing plate 13 to come into contact with the feed roller 7A. Thus, even when the removable tray 11 is supported at the attached position by the frame 15 without supporting a sheet thereon, the feed roller 7A is capable of feeding the sheet supported by the pressing plate 13. When a sheet is supported at the normal position by the upper surface of the second support member 17D of the removable tray 11 that is supported at the attached position by the frame 15, the sheet is positioned over the recess 17F of the second support member 17D. Thus, as the pressing plate 13 moves in the approaching direction, the sheet supported by the removable tray 11 comes into contact with the feed roller 7A. That is, the sheet supported by the removable tray 11 may prevent a sheet supported by the pressing plate 13 from contacting the feed roller 7A.

Accordingly, when the removable tray 11 supports a sheet at the normal position, the feed roller 7A may feed the sheet supported by the removable tray 11. When the removable tray 11 supports no sheet, the feed roller 7A may feed a sheet supported by the pressing plate 13.

The pivot shaft 17C is disposed at each end of the downstream end 17B portion of the first support member 17A in the width direction. The pivot shafts 17C support the stopper portion 18 such that the stopper portion 18 is pivotable.

<Stopper Portion>

The stopper portion 18 is movable between a restraining position (e.g., a position of the stopper portion 18 depicted in FIG. 5) and a non-restraining position (e.g., a position of the stopper portion 18 depicted in FIGS. 6 and 8A) that is a different position from the restraining position. When the stopper portion 18 is located at the restraining position (refer to FIG. 5), the stopper portion 18 restrains movement or displacement of a sheet supported at the normal position by the removable tray 11 in the first direction relative to the removable tray 11.

The stopper portion 18 includes an extended plate 18A (as an example of an extended member), a plurality of, for example, two, stopper tabs 18D, and a plurality of, for example, two, guide portions 18C.

The extended plate 18A has a plate-shaped rigid body and is disposed above the sheet support area in a sheet support surface of the support member 17, e.g., an upper surface of the support member 17. The extended plate 18A has an upstream end in the first direction. The extended plate 18A is pivotably supported by the pivot shafts 17C at respective ends thereof in the width direction. The extended plate 18A is pivotable on the pivot shafts 17C selectively in a direction that the extended plate 18A approaches the upper surface of the support member 17 where a sheet is to be supported (e.g., the sheet support surface) and in a direction that the extended plate 18A recedes from the sheet support surface of the support member 17. In a state where the stopper portion 18 is located at the restraining position as depicted in FIG. 5, the extended plate 18A extends in the first direction from the pivot shafts 17C in parallel to the sheet support surface of the support member 17. That is, in a state where the removable tray 11 supports a sheet and the stopper portion 18 is located at the restraining position, the extended plate 18A extends in the first direction along an upper surface of a sheet supported at the normal position by the removable tray 11 while covering a portion of the sheet. A maximum number of sheets, i.e., a maximum height of sheet stack, that the support member 17 is capable of supporting thereon, may be approximately equal to a distance between the upper surface of the support member 17 and a lower surface of the extended plate 18A located at the restraining position.

As depicted in FIG. 5, in the state where the extended plate 18A is located at the restraining position, a downstream end portion 18B of the extended plate 18A in the first direction is located upstream of the downstream end portion 17E of the second support member 17D in the first direction, which is involved by a size of the extended plate 18A that has a dimension in the first direction that is shorter than a dimension of the second support member 17D in the first direction.

The extended plate 18A has a recess 18H at a substantially middle portion of the downstream end portion 18B in the width direction. As depicted in FIGS. 3 and 4B, the recess 18H has a shape that might not interrupt insertion of the removable tray 11 to the attached position. More specifically, the recess 18H has a shape that might not interfere with a portion, which supports the feed unit 7 and the sidewalls 15D and extends in a direction opposite to the second direction, of the feed frame 15C.

In a state where the stopper portion 18 is located at the restraining position, the stopper tabs 18D are located downstream of the sheet support area in the first direction and extend in a direction intersecting a plane extending along the sheet support surface of the removable tray 11. The stopper tabs 18D are capable of contacting with a downstream edge of a sheet in the first direction that is supported at the normal position by the removable tray 11. In a state where the stopper tabs 18D are in contact with a downstream edge (e.g., a leading edge) of a sheet in the first direction that supported at the normal position by the removable tray 11, the stopper tabs 18D restrain movement or displacement of the sheet in the first direction relative to the removable tray 11.

The stopper tabs 18D are disposed at respective portions of the downstream end portion 18B of the extended plate 18A. As depicted in FIG. 3, the stopper tabs 18D (as an example of a first stopper tab and a second stopper tab) are disposed symmetrically with respect to the imaginary line L in the right-left direction. In other words, the stopper tabs 18D are disposed symmetrically with respect to the imaginary line L that divides the removable tray 11 into two equal portions in the width direction. As compared with a configuration in which the removable tray 11 includes a single stopper tab 18D on one of the right portion and the left portion of the downstream end portion 18B of the extended plate 18A with respect to the imaginary line L, the configuration according to the illustrative embodiment may further reduce or prevent a sheet from being angled relative to the first direction in a state where the sheet is supported at the normal position by the removable tray 11. Therefore, the removable tray 11 may further surely support the sheet at the normal position, whereby the feed roller 7A may also further surely feed the sheet supported by the removable tray 11. The stopper tabs 18D are located closer to the exterior of the image forming apparatus 1 than the respective sidewalls 15D. In a state where the removable tray 11 is supported at the attached position by the frame 15, the stopper tabs 18D are located closer to the exterior of the image forming apparatus 1 than the respective sidewalls 15D. Therefore, at the time of inserting the removable tray 11 to the attached position, this arrangement may reduce or prevent the stopper tabs 18D from contacting or interrupting the feed unit 7 and the sidewalls 15D.

The stopper tabs 18D may be made of resin. The stopper tabs 18D and the extended plate 18A may be integral with each other or consist of one piece. The stopper tabs 18D each include a base portion 18E and a projecting portion 18G. Both of the stopper tabs 18D have the same or similar configuration, and therefore, one of the stopper tabs 18D will be described in detail.

The base portion 18E extends in the first direction at a particular portion of the downstream end portion 18B of the extended plate 18A in the first direction. The base portion 18E includes a downstream end 18F in the first direction.

In a state where the stopper portion 18 is located at the restraining position, the projecting portion 18G extends from the downstream end 18F of the base portion 18E in a direction intersecting the plane extending along the sheet support surface of the removable tray 11. Thus, the projecting portion 18G is capable of contacting a downstream edge of a sheet supported by the removable tray 11. Therefore, the projecting portion 18G may reduce or prevent movement or displacement of the sheet in the first direction relative to the removable tray 11. The projecting portion 18G has a dimension in the direction intersecting the plane extending along the sheet support surface of the removable tray 11, that is greater than the distance between the sheet support surface of the support member 17 and the lower surface of the extended plate 18A located at the restraining position. Therefore, even when the support member 17 supports the maximum number of sheets thereon, the projecting portion 18G may restrain all of the sheets supported by the support member 17 from moving in the first direction relative to the removable tray 11. The projecting portion 18G is capable of contacting with the distal end of the downstream end portion 17E of the second support member 17D. That is, in a state where the projecting portion 18G is located at the restraining position, the projecting portion 18G includes a surface disposed adjacent to and downstream of the sheet support area in a first direction, the surface being capable of contacting a sheet support surface of the removable tray 11.

A procedure for placing a sheet at the normal position in the removable tray 11 will be described below.

As depicted in FIG. 5, the user orients the removable tray 11 such that the stopper portion 18 is positioned above the support member 17. In this state, the user place a sheet on the upper surface of the first support member 17A. Then, the user pushes an upstream edge of the sheet in the first direction to slide the sheet relative to the first support member 17A in the first direction. Thus, a downstream edge of the sheet in the first direction is located between the second support member 17D and the extended plate 18A of the stopper portion 18. As the user further slides the sheet in the first direction relative to the support member 17, the downstream edge of the sheet in the first direction comes into contact with the projecting portion 18G of the stopper tabs 18D. Thus, the placement of the sheet to the normal position in the removable tray 11 is completed.

As described above, in a state where the stopper portion 18 is located at the restraining position, the base portion 18E of each of the stopper tabs 18D extends in the first direction from the particular portion of the downstream end portion 18B of the extended plate 18A in the first direction. Therefore, as the user slides a sheet in the first direction relative to the upper surface of the support member 17, a downstream edge of the sheet in the first direction protrudes beyond a distal end of the downstream end portion 18B of the extended plate 18A. Thus, the user becomes able to see the sheet through the particular portions where the stopper tabs 18D are not disposed. Accordingly, the user may recognize the arrival of the sheet at the normal position both through feeling of resiliency of the stopper tabs 18D when the sheet comes into contact with the stopper tabs 18D and through visual observations. Therefore, the user may carry the removable tray 11 to a particular place for insertion of the removable tray 11 into the housing 3 of the image forming apparatus 1 while visually recognizing that the sheet that is surely supported at the normal position. This effect may be obtained using the plate-shaped extended plate 18A that covers the sheet supported at the normal position by the removable tray 11. Therefore, the extended plate 18A may reduce or prevent exposure of the sheet to wind caused by carry of the removable tray 11 to the particular place for insertion of the removable tray 11 into the housing 3 of the image forming apparatus 1, thereby reducing or preventing movement or displacement of the sheet supported at the normal position by the removable tray 11. In other embodiments, for example, the stopper tabs 18D may be disposed at an extended member having another configuration that might not cover a most portion of a sheet supported by the removable tray 11, for example, a lattice member, instead of the plate-shaped extended plate 18A of the illustrative embodiment. In this case, each of the stopper tabs 18D might not necessarily include a base portion 18E. The stopper tabs 18D each may include a projecting portion 18G extending directly from a downstream end of the extended member in the first direction. This configuration may also enable the user to visually recognize the sheet from above the removable tray 11.

The projecting portion 18G is capable of contacting with the distal end of the downstream end portion 17E of the second support member 17D. The downstream end portion 17E of the second support member 17D is located downstream of the downstream end portion 18B of the extended plate 18A located at the restraining position in the first direction. Therefore, as compared with a case where the downstream end portion 17E of the second support member 17D is located upstream of the downstream end portion 18B of the extended plate 18A located at the restraining position in the first direction, a downstream edge of a sheet contacting with the stopper tabs 18D might not tend to protrude from the second support member 17D. Accordingly, this configuration may reduce or prevent movement or displacement a sheet from the normal position and hanging down of the sheet from the second support member 17D.

As depicted in FIG. 5, the guide portions 18C may be made of resin. The guide portions 18C and the extended plate 18A may be integral with each other or consist of one piece. At the downstream end portion 18B of the extended plate 18A, one of the guide portions 18C is disposed between one of the stopper tabs 18D and one edge defining of the recess 18H in the width direction and the other of the guide portions 18C is disposed between the other of the stopper tabs 18D and the other edge defining the recess 18H in the width direction.

In the state where the stopper portion 18 is located at the restraining position, each of the guide portions 18C is inclined such that a distance between an upstream edge of the guide portions 18C in the first direction and the sheet support surface is smaller than the distance between a downstream location along the guide portions 18C in the first direction and the sheet support surface. A height of each of the guide portion 18C from the upper surface of the extended plate 18A to a most downstream portion of the guide portion 18C in the first direction is greater than a dimension of each of the projecting portions 18G in a direction intersecting the plane extending along the support member 17.

If the stopper portion 18 is retained at the restraining position in a state where the removable tray 11 is supported at the attached position by the frame 15, the stopper portion 18 restrains movement of a sheet in the first direction when the feed roller 7A feeds the sheet supported by the removable tray 11, whereby the feed roller 7A might not be able to feed the sheet. In the illustrative embodiment, the guide portions 18C slide over inclined portions 21A of the retaining portions 21, respectively, and thus are located above the inclined portions 21A of the retaining portions 21. Thus, the stopper portion 18 may be moved to the non-restraining position (refer to FIGS. 6 and 8A) that is a different position from the restraining position and at which the stopper portion 18 might not interrupt feeding of a sheet in the first direction, whereby enabling the feed roller 7A to feed the sheet supported by the removable tray 11.

In the illustrative embodiment, the stopper portion 18 includes two guide portions 18C. Nevertheless, in other embodiments, for example, the stopper portion 18 may include a single guide portion 18C.

<Retained Portions>

As depicted in FIG. 5, one of the retained portions 19 is disposed at one end of the first support member 17A in the width direction and the other of the retained portions 19 is disposed at the other end of the first support member 17A in the width direction. Each of the retained portions 19 is at an outward position from a corresponding one of the side guides 22 relative to the first support member 17A in the width direction. Each of the retained portions 19 extends in the first direction and includes a downstream end 19A, a leaf spring 19B, and a supporting protrusion 19C. The leaf spring 19B has a downstream end that may be a fixed end and an upstream end that may be a free end in the first direction. The leaf spring 19B elastically deforms in a direction intersecting a plane extending along the sheet support surface of the supporting member 17, on the fixed end. The supporting protrusion 19C is disposed at the free end of the leaf spring 19B and protrudes upward therefrom.

The retained portions 19 are retained by the rail 20 of the first frame 15A and the rail 20 of the second frame 15B, respectively, of the image forming apparatus 1 in a state where the removable tray 11 is located at the attached position, whereby removable tray 11 is retained at the attached position by the frame 15.

<Detailed Configuration of Rails>

Figure 7:
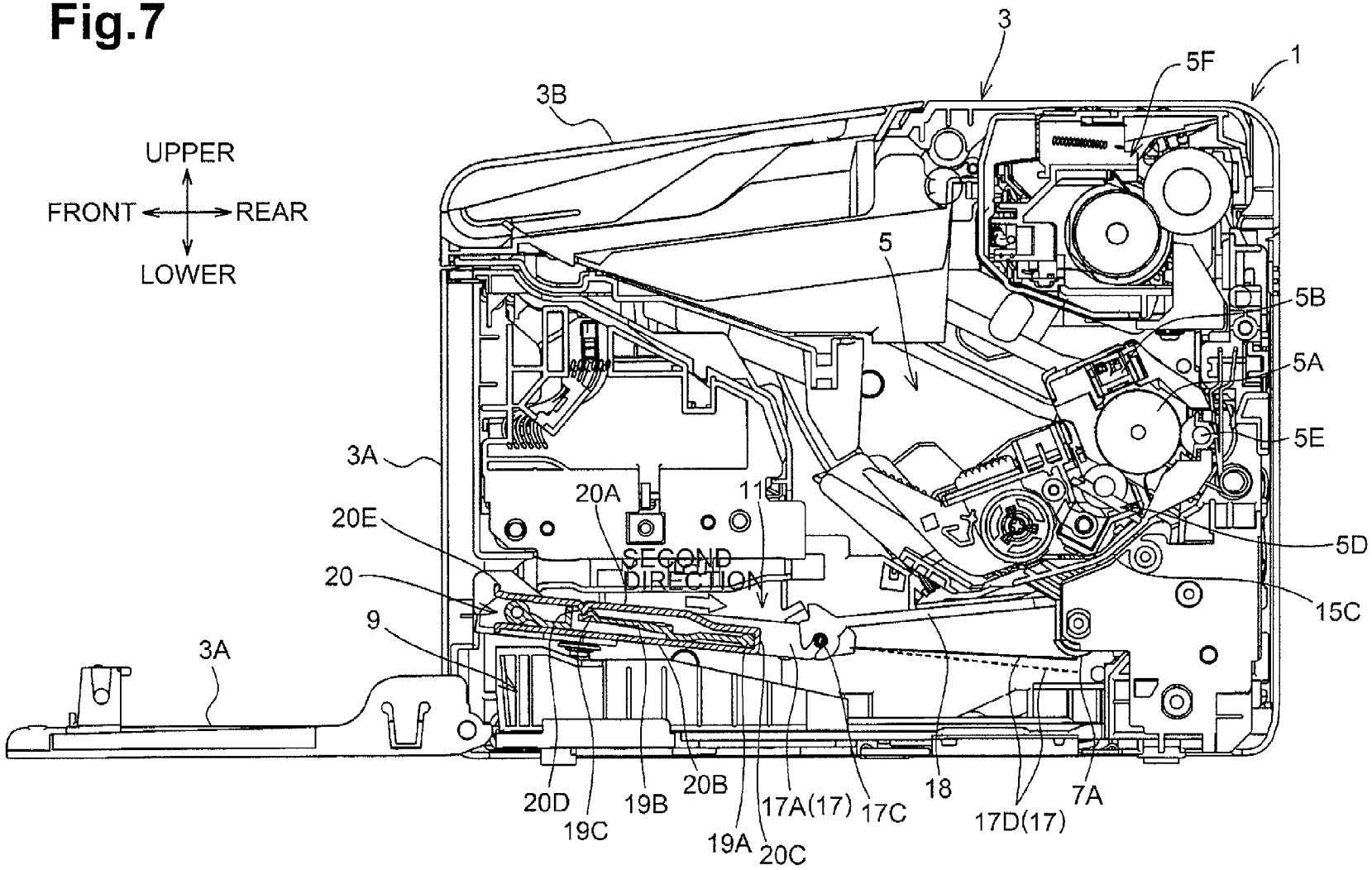
FIG. 7 is a cross-sectional side view depicting the image forming apparatus in the illustrative embodiment according to one or more aspects of the disclosure, wherein a rail is illustrated in sectional view.

The rails 20 (as an example of a first guide) are disposed at the first frame 15A and the second frame 15B, respectively, of the frame 15. Although FIGS. 4A and 4B illustrate the rail 20 of the second frame 15B only, the rail 20 of the first frame 15A also has the same or similar configuration to the rail 20 of the second frame 15. In the description below, therefore, one of the rails 20 will be described in detail. As depicted in FIG. 7, the rail 20 includes an upper wall 20A, a lower wall 20B, a retaining wall 20C, a protrusion 20D, and an upstream end 20E in the second direction.

The upper wall 20A and the lower wall 20B face each other and guide one of the retained portions 19 of the removable tray 11 to the attached position. The upper wall 20A and the lower wall 20B are inclined downward toward the rear of the image forming apparatus 1 and extend in the second direction. That is, the second direction is angled relative to the horizontal direction and inclined downward toward the rear of the image forming apparatus 1. With this configuration, while the user inserts the removable tray 11 into the housing 3 to the attached position, a sheet supported by the removable tray 11 may be kept in contact with the stopper tabs 18D of the stopper portion 18 by gravitation acting on the sheet. Therefore, this configuration may further reduce or prevent movement or displacement of a sheet supported the removable tray 11 from the normal position as compared with a case where the upper wall 20A and the lower wall 20B of the rail 20 extend in the horizontal direction or a case where the lower wall 20B of the rail 20 are inclined upward toward the rear of the image forming apparatus 1.

The retaining wall 20C extends perpendicular to the upper wall 20A and the lower wall 20B. The retaining wall 20C restrains further movement of the removable tray 11 in the second direction by contacting with the downstream end 19A of the retained portion 19 of the removable tray 11 guided along the upper wall 20A and the lower wall 20B. The position of the removable tray 11 when the retaining wall 20C and the downstream end 19A of the retained portion 19 of the removable tray 11 are in contact with each other may refer to the attached position of the removable tray 11.

The protrusion 20D protrudes downward from the upper wall 20A. The protrusion 20D presses the supporting protrusion 19C of the retained portion 19 of the removable tray 11 located at the attached position to restrain movement of the removable tray 11 in a direction opposite to the second direction.

With this configuration, the rails 20 guide the removable tray 11 to the attached position in the housing 3 and retain the removable tray 11 at the attached position. Retaining the removable tray 11 at the attached position may refer to supporting the removable tray 11 such that the removable tray 11 does not move from the attached position by its own weight. With this configuration, even when the image forming apparatus 1 is tilted such that the upstream end 20E of the rail 20 is located at a lower position than the retaining wall 20C of the rail 20, the rail 20 retains the removable tray 11 at the attached position. Therefore, the removable tray 11 supported at the attached position might not come out of the housing 3. As depicted in FIGS. 3 and 8A, when the removable tray 11 is located at the attached position, in the stopper portion 18, the downstream ends 18F of the stopper tabs 18D are aligned with the feed roller 7A in the axial direction of the rotating shaft 7E of the feed roller 7A (corresponding to the right-left direction and the width direction). Therefore, this configuration may surely position a sheet supported by the removable tray 11 immediately below the feed roller 7A as compared with a configuration in which, for example, the downstream ends 18F of the stopper tabs 18D are located upstream of the rotating shaft 7E of the feed roller 7A in the second direction when the removable tray 11 is located at the attached position. Accordingly, this configuration may enable the feed roller 7A to further surely feed a sheet supported at the normal position by the removable tray 11.

<Detailed Configuration of Retaining Portions>

As depicted in FIG. 4A, the retaining portions 21 have a substantially L-shape when viewed from the front of the image forming apparatus 1 and extend along the second direction. One of the retaining portions 21 includes a portion connected with one of the sidewalls 15D, and an inclined portion 21A. The other of the retaining portions 21 includes a portion connected with the other of the sidewalls 15D, and an inclined portion 21A. The sidewalls 15D and the retaining portions 21 connected with the respective sidewalls 15D both extend along the second direction. Therefore, this configuration may increase in strength of the retaining portions 21 as compared with a case where the retaining portions 21 are disposed at the feed frame 15C not including the sidewalls 15D. Both of the retaining portions 21 have the same or similar configuration, and therefore, one of the retaining portions 21 will be described in detail.

The inclined portion 21A extends along the sheet support surface of the removable tray 11 when the removable tray 11 is attached to the frame 15. As depicted in FIG. 4A and as indicated by a dashed line in FIG. 8A, a height of the inclined portion 21A increases in the second direction. That is, the inclined portion 21A is inclined such that a distance between an upstream edge of the inclined portion 21A in the first direction and the sheet support surface is smaller than a distance between a downstream location along the inclined portion 21A in the first direction and the sheet support surface. While the removable tray 11 is guided in the second direction, the inclined portion 21A of the retaining portion 21 comes into contact with the guide portion 18C of the removable tray 11. As the removable tray 11 is further guided in the second direction, the guide portion 18C slides over the inclined portion 21A to locate above the inclined portion 21A. In accordance with this movement, the stopper portion 18 of the removable tray 11 moves from the restraining position in the direction that the stopper portion 18 recedes from the sheet supported by the removable tray 11. Then, the removable tray 11 reaches the attached position and is thus supported at the attached position by the frame 15. In this state, as depicted in FIGS. 6 and 8A, the guide portion 18C is located above the inclined portion 21A of the retaining portion 21. Therefore, the retaining portion 21 retains the stopper portion 18 of the removable tray 11 at the non-restraining position.

As depicted in FIG. 8A, an inclination of an upstream portion of the inclined portion 21A in the second direction is greater than an inclination of a downstream portion of the inclined portion 21A in the second direction. This configuration may enable the guide portion 18C of the removable tray 11 to slide over the inclined portion 21A of the retaining portion 21 easily.

A user may need to insert a sheet to a far end portion of a removable tray such that a feed roller can surely feed a sheet supported by a removable tray. At the time of placing a sheet on the removable tray connected with a frame inside the housing, the user may need to insert the sheet along the removable tray toward the interior of the housing where the feed roller may be disposed. However, at the time of placing a sheet having relatively small size, e.g., an A5-size sheet, on the removable tray connected with the frame such that shorter sides of the sheet extend along the first direction, it may be difficult for the user to insert the sheet to the far end portion of the removable tray because a user's hand may easily interfere with the housing or the user might not be able to check an insertion position of the sheet being inserted into the housing. Therefore, the feed roller might not be able to feed the sheet due to, for example, misalignment of the sheet on the removable tray. More specifically, the sheet might not be supported at a proper position where the sheet comes into contact with the feed roller. However, in the illustrative embodiment, as described above, the user is allowed to insert a sheet into the removable tray 11 that is separated from the image forming apparatus 1. Therefore, the user may insert a sheet into the removable tray 11 in various situations. For example, the user may insert a sheet into the removable tray 11 while the removable tray 11 is placed on a table or while holding the removable tray 11 by hand.

At the time of placing a sheet on a removable tray that is removed from a frame of an image forming apparatus, it may be difficult for the user to guess where to place the sheet or where to align a leading edge of the sheet. Therefore, the sheet may surely be placed at a proper position in the removable tray. More specifically, in a case where the removable tray is attached to the frame after the sheet is placed on the removed removable tray, the feed roller might not be able to feed the sheet. However, in the illustrative embodiment, removable tray 11 includes the stopper portion 18 which is movable between the restraining position and the non-restraining position and which includes the surface disposed adjacent to and downstream of the sheet support area in the first direction, in a state where the stopper portion 18 is located at the restraining position. Therefore, at the time of placing a sheet into the detached removable tray 11, the user inserts a sheet into the removable tray 11 until a downstream edge of the sheet in the first direction comes into contact with the stopper portion 18 in the first direction. By doing so, the sheet may surely be placed at the proper position in the removable tray 11. Accordingly, convenience of the removable tray 11 that is attachable to and detachable from the frame 15 disposed inside the housing 3 may be increased at the time of placing a sheet on the removable tray 11.

Thereafter, the user inserts the removable tray 11 supporting the sheet into the housing 3 along the rails 20 until the removable tray 11 reaches the attached position. By doing so, the sheet may be surely guided to and located at a particular position where the feed roller 7A feeds a sheet. In a state where the removable tray 11 is supported at the attached position by the frame 15, the retaining portions 21 retain the stopper portion 18 at the non-restraining position. Therefore, the stopper portion 18 might not obstruct the feeding of a sheet in the first direction relative to the removable tray 11. Accordingly, the feed roller 7A may further surely feed a sheet supported by the removable tray 11.

In the illustrative embodiment, in a state where the removable tray 11 is supported at the attached position by the frame 15, the stopper portion 18 is retained at the non-restraining position while the guide portions 18C of the removable tray 11 are located above the respective retaining portions 21. Therefore, this configuration may reduce power consumption in the image forming apparatus 1 as compared with a configuration in which the stopper portion 18 is moved to the non-restraining position by a drive mechanism using a motor.

In the illustrative embodiment, the stopper portion 18 of the removable tray 11 is pivotable on the pivot shafts 17C selectively in the direction that the stopper portion 18 approaches the sheet support surface of the support member 17 and in the direction that the stopper portion 18 recedes from the sheet support surface of the support member 17. In a state where the stopper portion 18 is located at the restraining position, the stopper tabs 18D are in contact with a downstream edge of a sheet supported at the normal position by the support member 17. By moving the removable tray 11 from the attached position in the image forming apparatus 1, the stopper portion 18 may be moved to the restraining position from the non-restraining position by gravitation. In other embodiments, for example, the stopper portion 18 may be configured to change its position between the restraining position and the non-restraining position by sliding therebetween in the width direction. In this case, when the stopper portion 18 is located at the restraining position, the stopper portion 18 may be in contact with a downstream edge of a sheet supported at the normal position by the support member 17. When the stopper portion 18 is located at the non-restraining position, the stopper portion 18 may be located at a position closer to the exterior of the image forming apparatus 1 than one of side edges of the sheet in the width direction.

While the disclosure has been described in detail with reference to the specific embodiment thereof, this is merely an example, and various changes, arrangements and modifications may be applied therein without departing from the spirit and scope of the disclosure.

What is claimed is:

1. An image forming apparatus comprising:
- an image forming mechanism;
- a frame supporting the image forming mechanism, the frame including a pair of sidewalls positioned at a midportion of the image forming apparatus and an inclined retaining portion disposed at at least one of the side walls;
- a housing covering the frame; and
- a removable tray configured to:
  - be attachable to and detachable from the frame;
- the removable tray including:
  - a sheet support surface providing a sheet support area above the sheet support surface; and
  - a stopper portion movable between a restraining position and a non-restraining position that is a different position from the restraining position, wherein, in a state where the stopper portion is located at the restraining position, the stopper portion includes a surface disposed adjacent to and downstream of the sheet support area in a first direction, wherein the first direction extends along at least a portion of the sheet support surface, and
- wherein, in a state where the stopper portion is located at the non-restraining position, a guide portion of the stopper portion is positioned over the inclined retaining portion to position the surface of the stopper portion away from the sheet support area.

2. The image forming apparatus according to claim 1, wherein the surface of the stopper portion restrains a sheet from moving from a normal position in the sheet support area on the sheet support surface in the first direction.

3. The image forming apparatus according to claim 1, further comprising:
- a first guide disposed at the frame and configured to guide the removable tray to an attached position; and
- a retaining portion configured to retain the stopper portion at the non-restraining position in a state where the removable tray is supported at the attached position by the frame.

4. The image forming apparatus according to claim 3, further comprising:
- a feed roller; and
- a second guide configured to guide a sheet fed by the feed roller from the removable tray to the image forming mechanism.

5. The image forming apparatus according to claim 3,
- wherein the removable tray includes a pivot shaft supporting the stopper portion configured to move selectively in a direction that the stopper portion approaches the sheet support surface of the removable tray and in a direction that the stopper portion recedes from the sheet support surface of the removable tray,
- wherein the retaining portion includes an inclined portion that extends along the sheet support surface of the removable tray when the removable tray is attached to the frame, wherein the inclined portion is inclined such that a distance between an upstream edge of the inclined portion in the first direction and the sheet support surface is smaller than a distance between a downstream location along the inclined portion in the first direction and the sheet support surface, wherein the stopper portion includes a guide portion that is inclined such that a distance between an upstream edge of the guide portion in the first direction and the sheet support surface is smaller than a distance between a downstream location along the guide portion in the first direction and the sheet support surface, and wherein in the state where the removable tray is supported at the attached position by the frame, the guide portion is located above the inclined portion of the retaining portion.

6. The image forming apparatus according to claim 2, wherein the removable tray further includes:

a support member including the sheet support surface and configured to support the sheet at the normal position on the sheet support surface; and a pivot shaft supporting the stopper portion configured to move selectively in a direction that the stopper portion approaches the sheet support surface of the support member and in a direction that the stopper portion recedes from the sheet support surface of the removable tray, wherein the stopper portion includes:

an extended member supported by the pivot shaft and extending in the first direction along the sheet support surface of the removable tray in a state where the stopper portion is located at the restraining position; and a stopper tab, wherein, in a state where the stopper portion is located at the restraining position:

(i) the stopper tab is disposed at a downstream end portion of the extended member in the first direction; and (ii) the stopper tab is located downstream of the sheet support area in the first direction.

7. The image forming apparatus according to claim 3, wherein a second direction is the same as the first direction when the direction that the first guide guides the removable tray from the outside of the housing into the inside of the housing is the second direction, and the first guide is inclined downward in the second direction.

8. The image forming apparatus according to claim 6, wherein the stopper tab has a dimension in a direction intersecting the plane extending along the sheet support surface of the removable tray, that is greater than a distance between the sheet support surface of the support member and the extended member located at the restraining position.

9. The image forming apparatus according to claim 6, further comprising:

a feed roller, wherein in a state the removable tray is located at the attached position, a downstream end portion in the first direction of the stopper tab located at the restraining position is aligned with the feed roller in an axial direction of a rotating shaft of the feed roller.

10. The image forming apparatus according to claim 6, wherein the extended member has a plate-shaped body positioned above the sheet supporting area in the state where the extended member is located at the restraining position, wherein the stopper tab includes:

a base portion extending in the first direction from a particular portion of the downward end portion of the extended member located at the restraining position; and a projecting portion extending in a direction intersecting the plane extending along the sheet support surface of the removable tray, from a downstream end of the base portion in the first direction of the stopper tab located the restraining position.

11. The image forming apparatus according to claim 10, wherein a downstream end portion of the support member in the first direction is located downstream of the downstream end portion of the extended member located at the restraining position.

12. The image forming apparatus according to claim 6, further comprising:

a feed roller, wherein the feed roller is disposed on an imaginary line that divides the removable tray into equal two portion in a direction orthogonal to the first direction, wherein the stopper tab includes:

a first stopper tab; and a second stopper tab, wherein the first stopper tab and the second stopper tab are disposed symmetrically with respect to the imaginary line.

13. The image forming apparatus according to claim 6, further comprising:

a feed roller;

a feed tray disposed below the removable tray supported at the attached position by the frame; and a pressing plate disposed at the feed tray and configured to move selectively in a direction that the pressing plate approaches the feed roller and in a direction that the pressing plate recedes from the feed roller, wherein the support member includes:

a first support member including a downstream end in the first direction; and a second support member extending in the first direction from the downstream end of the first support member, the second support member configured to move selectively in a direction that the second support member approaches the feed roller and in a direction that the second support member recedes from the feed roller in a state where the removable tray is supported at the attached position by the frame, and wherein the second support member allows the sheet supported by the pressing plate to come into contact with the feed roller in a state where the removable tray is supported at the attached position by the frame while the removable tray supports no sheet on the sheet support surface.

14. The image forming apparatus according to claim 13, wherein the second support member is made of elastically deformable resin.

15. The image forming apparatus of claim 1, further comprising a feed roller, wherein the pair of sidewalls are positioned to either side of the feed roller.

16. An image forming apparatus comprising:

an image forming mechanism;

a frame supporting the image forming mechanism;

a housing covering the frame;

a removable tray configured to be attachable to and detachable from the frame;

a first guide disposed at the frame and configured to guide the removable tray to an attached position; and a retaining portion, the removable tray including:

a sheet support surface providing a sheet support area above the sheet support surface;

a stopper portion movable between a restraining position and a non-restraining position that is a different position from the restraining position, wherein, in a state where the stopper portion is located at the restraining position, the stopper portion includes a surface disposed adjacent to and downstream of the sheet support area in a first direction, wherein the first direction extends along at least a portion of the sheet support surface;

a pivot shaft supporting the stopper portion configured to move selectively in a direction that the stopper portion approaches the sheet support surface of the removable tray and in a direction that the stopper portion recedes from the sheet support surface of the removable tray;

wherein the retaining portion includes an inclined portion that extends along the sheet support surface of the removable tray when the removable tray is attached to the frame, wherein the inclined portion is inclined such that a distance between an upstream edge of the inclined portion in the first direction and the sheet support surface is smaller than a distance between a downstream location along the inclined portion in the first direction and the sheet support surface, wherein the stopper portion includes a guide portion that is inclined such that a distance between an upstream edge of the guide portion in the first direction and the sheet support surface is smaller than a distance between a downstream location along the guide portion in the first direction and the sheet support surface, and wherein in the state where the removable tray is supported at the attached position by the frame, the guide portion is located above the inclined portion of the retaining portion.

17. An image forming apparatus comprising:

an image forming mechanism;

a frame supporting the image forming mechanism a housing covering the frame;

a removable tray configured to be attachable to and detachable from the frame;

a first guide disposed at the frame and configured to guide the removable tray to an attached position;

a retaining portion;

a feed roller; and a second guide configured to guide a sheet fed by the feed roller from the removable tray to the image forming mechanism the removable tray including:

a sheet support surface providing a sheet support area above the sheet support surface; and a stopper portion movable between a restraining position and a non-restraining position that is a different position from the restraining position, wherein, in a state where the stopper portion is located at the restraining position, the stopper portion includes a surface disposed adjacent to and downstream of the sheet support area in a first direction, wherein the first direction extends along at least a portion of the sheet support surface;

wherein the retaining portion is configured to retain the stopper portion at the non-restraining position in a state where the removable tray is supported at the attached position by the frame, wherein the frame includes two sidewalls disposed on opposite side of the feed roller in an axial direction of a rotating shaft of the feed roller, and wherein the retaining portion is disposed at at least one of the side walls.

18. An image forming apparatus comprising:

an image forming mechanism;

a frame supporting the image forming mechanism a housing covering the frame;

a removable tray configured to be attachable to and detachable from the frame;

a first guide disposed at the frame and configured to guide the removable tray to an attached position; and a retaining portion;

the removable tray including:

a sheet support surface providing a sheet support area above the sheet support surface; and a stopper portion movable between a restraining position and a non-restraining position that is a different position from the restraining position, wherein, in a state where the stopper portion is located at the restraining position, the stopper portion includes a surface disposed adjacent to and downstream of the sheet support area in a first direction, wherein the first direction extends along at least a portion of the sheet support surface, wherein a second direction is the same as the first direction when the direction that the first guide guides the removable tray from the outside of the housing into the inside of the housing is the second direction, and the first guide is inclined downward in the second direction, wherein the retaining portion is configured to retain the stopper portion at the non-restraining position in a state where the removable tray is supported at the attached position by the frame.

19. An image forming apparatus comprising:

an image forming mechanism;

a frame supporting the image forming mechanism a housing covering the frame;

a feed roller; and a removable tray configured to be attachable to and detachable from the frame;

the removable tray including:

a sheet support surface providing a sheet support area above the sheet support surface;

a support member including the sheet support surface and configured to support the sheet at the normal position on the sheet support surface;

a stopper portion movable between a restraining position and a non-restraining position that is a different position from the restraining position, wherein, in a state where the stopper portion is located at the restraining position, the stopper portion includes a surface disposed adjacent to and downstream of the sheet support area in a first direction, wherein the first direction extends along at least a portion of the sheet support surface, wherein the surface of the stopper portion restrains a sheet from moving from a normal position in the sheet support area on the sheet support surface in the first direction; and a pivot shaft supporting the stopper portion configured to move selectively in a direction that the stopper portion approaches the sheet support surface of the support member and in a direction that the stopper portion recedes from the sheet support surface of the removable tray, wherein the stopper portion further includes:

an extended member supported by the pivot shaft and extending the first direction along the sheet support surface of the removable tray in a state where the stopper portion is located at the restraining position; and a stopper tab, wherein, in a state where the stopper portion is located at the restraining position:

(i) the stopper tab is disposed at a downstream end portion of the extended member in the first direction; and (ii) the stopper tab is located downstream of the sheet support area in the first direction, wherein in a state the removable tray is located at the attached position, a downstream end portion in the first direction of the stopper tab located at the restraining position is aligned with the feed roller in an axial direction of a rotating shaft of the feed roller.

20. An image forming apparatus comprising:

an image forming mechanism;

a frame supporting the image forming mechanism a housing covering the frame;

a removable tray configured to be attachable to and detachable from the frame; and a feed roller, the feed roller disposed on an imaginary line that divides the removable tray into equal two portions in a direction orthogonal to the first direction, the removable tray including:

a sheet support surface providing a sheet support area above the sheet support surface;

a support member including the sheet support surface and configured to support the sheet at the normal position on the sheet support surface;

a stopper portion movable between a restraining position and a non-restraining position that is a different position from the restraining position, wherein, in a state where the stopper portion is located at the restraining position, the stopper portion includes a surface disposed adjacent to and downstream of the sheet support area in a first direction, wherein the first direction extends along at least a portion of the sheet support surface, wherein the surface of the stopper portion restrains a sheet from moving from a normal position in the sheet support area on the sheet support surface in the first direction; and a pivot shaft supporting the stopper portion configured to move selectively in a direction that the stopper portion approaches the sheet support surface of the support member and in a direction that the stopper portion recedes from the sheet support surface of the removable tray, wherein the stopper portion further includes:

an extended member supported by the pivot shaft and extending the first direction along the sheet support surface of the removable tray in a state where the stopper portion is located at the restraining position; and a stopper tab including a first stopper tab and a second stopper tab, the first and second stopper tabs disposed symmetrically with respect to the imaginary line that divides the removable tray, and wherein, in a state where the stopper portion is located at the restraining position:

(i) the stopper tab is disposed at a downstream end portion of the extended member in the first direction; and (ii) the stopper tab is located downstream of the sheet support area in the first direction.

* * * * *